United States Patent [19]

Bartasius

[11] Patent Number: 4,948,129

[45] Date of Patent: Aug. 14, 1990

[54] APPARATUS FOR ENTRAPPING ERRANT TENNIS BALLS

[76] Inventor: Joseph A. Bartasius, 3713 Valley Park Way, Lake Worth, Fla. 33467

[21] Appl. No.: 412,119

[22] Filed: Sep. 25, 1989

Related U.S. Application Data

[63] Continuation-in-part of Ser. No. 300,589, Jan. 23, 1989, Pat. No. 4,895,366.

[51] Int. Cl.[5] ..... A63B 61/00

[52] U.S. Cl. ..... 273/29 B

[58] Field of Search ..... 273/29 R, 29 A, 26 D, 273/176, 395, 182 A, 181 F

[56] References Cited

U.S. PATENT DOCUMENTS

| | | | |
|---|---|---|---|
| 4,073,491 | 2/1978 | Sepaniac | 273/29 B |
| 4,568,089 | 2/1986 | Scott et al. | 273/29 B |
| 4,575,081 | 3/1986 | Cavanagh | 273/29 A |

FOREIGN PATENT DOCUMENTS

| | | | |
|---|---|---|---|
| 8203019 | 9/1982 | Australia | 273/29 B |

*Primary Examiner*—Theatrice Brown

*Attorney, Agent, or Firm*—Victor F. Volk

[57] ABSTRACT

The invention relates to a meshwork made up of a plurality of horizontal and vertically extending strands defining a plurality of openings; the openings being of a size to allow a regulation tennis ball to pass therethrough. The meshwork is suspended in a parallel spaced relationship from a vertically extending wall surronding a tennis court; the wall being impervious to the passage of balls. Each of the openings of the meshwork being covered by a strip of material which is impervious to passage of a ball. The strip being attached at their upper end only, between the wall and the meshwork such that a ball will pass through the meshwork opening, rebound from the wall, deflect from the strips and come to rest on the ground between the meshwork and wall. Pivotal brackets are provided for supporting the meshwork in spaced relationship to the wall.

8 Claims, 2 Drawing Sheets

APPARATUS FOR ENTRAPPING ERRANT TENNIS BALLS

Continuation-in-part of application Ser. No. 300,589, filed Jan. 23, 1989; now U.S. Pat. No. 4,895,366.

BACKGROUND OF THE INVENTION

This invention solves a problem that arises in the playing of tennis when out-of-bounds balls are deflected back into the playing area after striking an enclosing wall or fence. Such balls are not only distracting to the players but can be dangerous if they are inadvertently stepped upon during play. The placing of soft nets around the field to absorb the energy of errant balls has been suggested but does not suffice since a positive entrapment is required really to provide an adequate safety factor. The present invention offers positive entrapment of errant balls by means of an inexpensive novel structure.

SUMMARY OF THE INVENTION

I have invented a positive entrapment apparatus for tennis balls comprising a vertical confining structure such as a wall or chain link fence combined with a longitudinal meshwork suspended parallel to the inwardly facing surface of the confining structure. This meshwork comprises a plurality of interconnected horizontal and vertical strands that define openings large enough to permit the outward passage of a standard tennis ball, and a plurality of flexible barrier strips such as strips of standard tennis net fabric. The upper edges of the strips are fastened to the horizontal strands of the meshwork and their lower edges, which, preferably, extend below the next lower horizontal meshwork strand, hand free. These strips prevent balls which rebound from the wall or fence structure from passing back through the meshwork. My apparatus comprises supporting means for the meshwork that projects from an elevated portion of the fence or wall structure. Advantageously, also, these brackets may comprise retracting angle arms that will yield harmlessly on human impact.

By forming my barrier strips of closely woven strands, such, for example as a light canvas or a fabric formed of strands of polypropylene, my apparatus can also be made to serve as a wind breaker.

DETAILED DESCRIPTION OF PREFERRED EMBODIMENT

Figure 1:
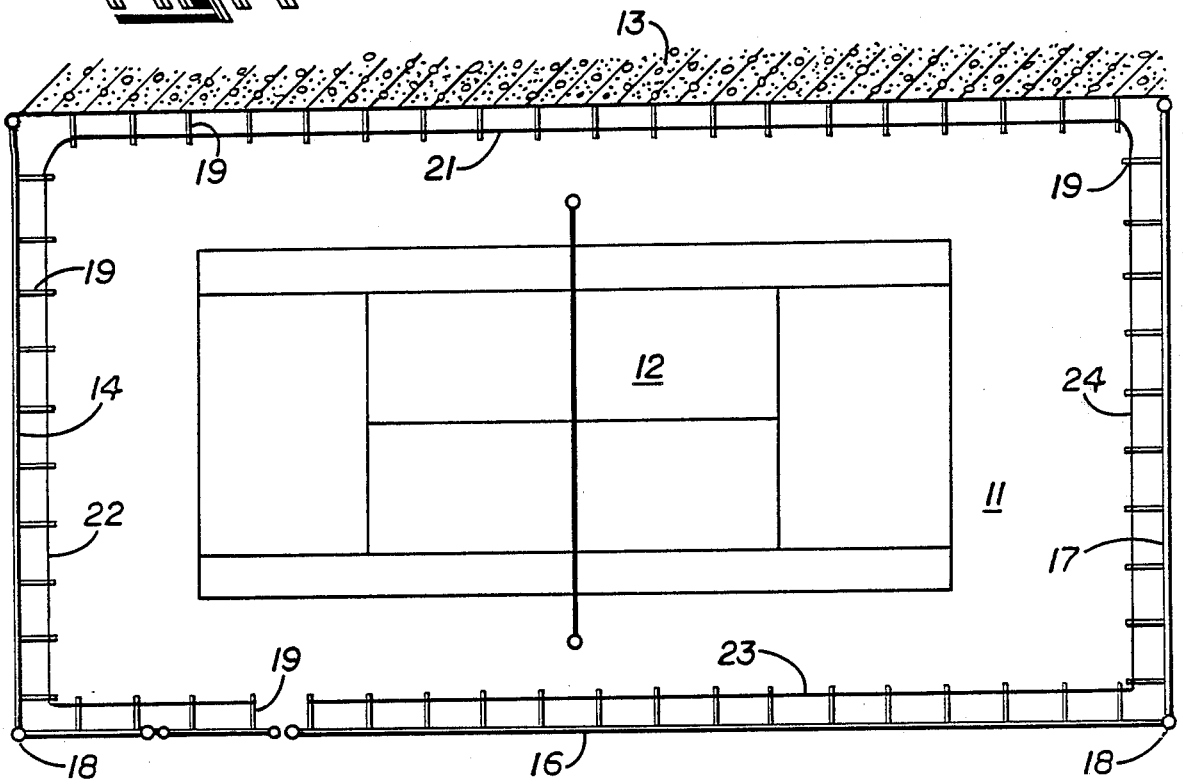
FIG. 1 is a plan view of a tennis playing area with apparatus hanging brackets enlarged for clarity.
Figure 2:
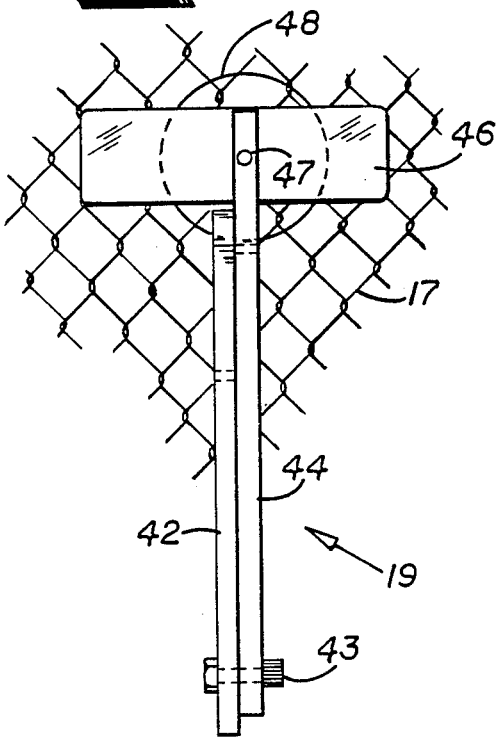
FIG. 2 is a side elevation of a portion of chain link fence with one of my supports attached.
Figure 4:
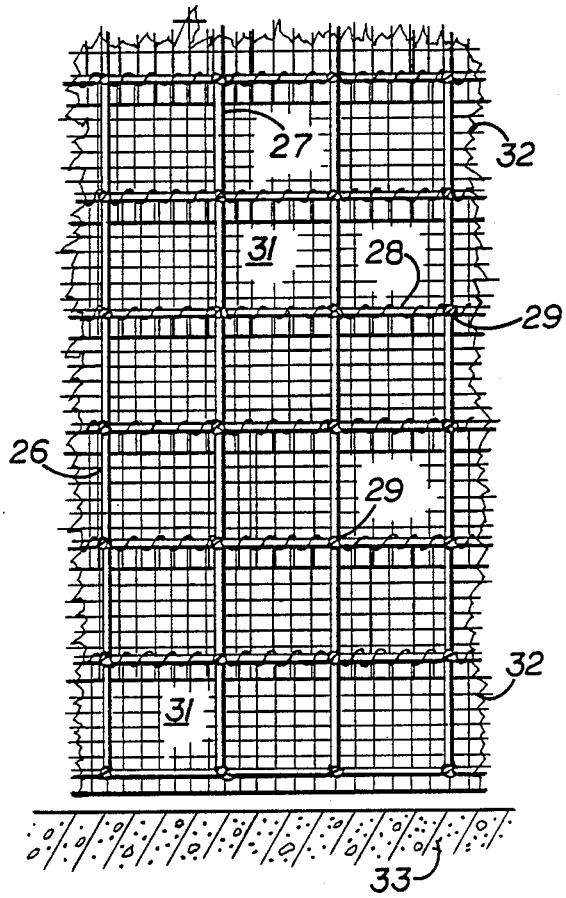
FIG. 4 is a side elevation of my apparatus.

In FIG. 1 a rectangular playing area 11 containing a tennis court 12 is shown enclosed by vertical structures comprising a masonry wall 13 on one side and three chain link fences 14, 16, 17 on the other three sides. The fences are held up, in the usual manner, by spaced-apart posts 18—18. Spaced inwardly from the wall 13 and fences 14, 16, 17 and suspended therefrom by brackets 19—19 are running lengths 21—24 of meshwork 26 (FIG. 4). The supports 16 are spaced at about 5-foot (1.54 m) intervals at a height of about 5 feet but other heights can be selected within the scope of my invention depending, usually, upon how close the structures 13,14,16,17 are to the tennis court 12 and the likelihood of an errant ball striking at an elevated point. I have found, indeed, that, since the large majority of struck balls in tennis have their principal velocity component lengthwise of the court the side meshworks 21, 23 may economically be omitted, at least in the mid-court area, and most of the errant balls will still be entrapped at the end fences 14, 17 by the meshworks 22, 24.

Figure 5:
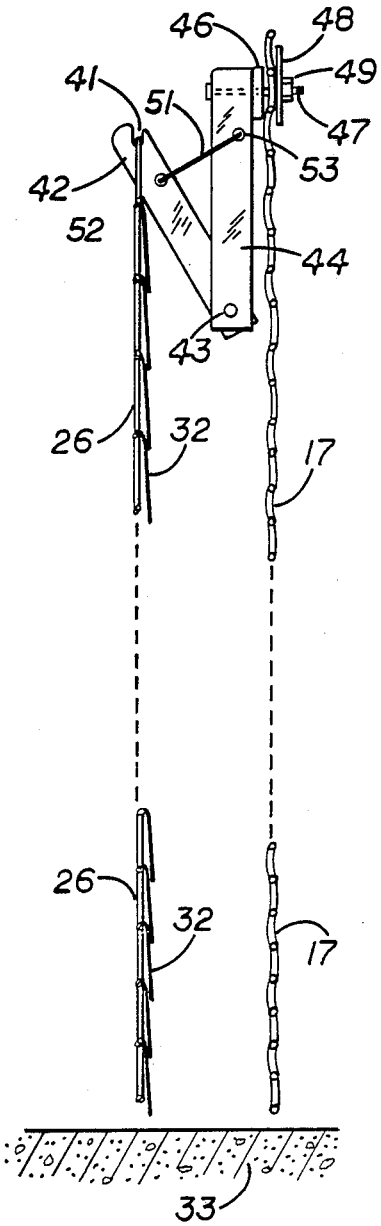
FIG. 5 is a section through the lines 5—5 of FIG. 4.
Figure 6:
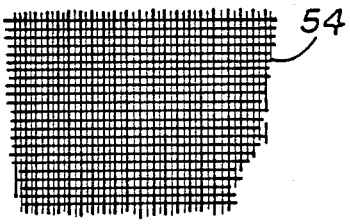
FIG. 6 is an elevation of a portion of closely woven barrier strip.

The meshwork 26 (FIGS. 4 and 5) is comprised of vertical strands 27—27 and horizontal strands 28—28 tied or otherwise connected together at their intersections 29—29 to define square openings 31—31 about 5 inches (12.7 cm) on a side, through which a tennis ball can pass freely. I prefer to use standard soccer ball net material for the meshwork 26 since it is commercially available and reasonably priced. In this case, of course, each long extent of horizontal strand 28 or vertical strand 27 is formed by connecting together shorter strand lengths in the known manner. Attached to each of the horizontal strands 28, except the lowermost, a strip such as strips 32—32 is attached, as by a spiral thread. The strips 32 preferably comprise conventional tennis net fabric with open spacing, but, where it is desired to have the meshwork structure also serve as a wind breaker, close woven fabrics such as fabrics of polypropylene filament may be used for the strips 32. This strip is about six inches (15.4 cm) wide so that it extends beyond the next lower of the strands 28. An errant ball that reaches the meshwork length 24 thus passes through one of the openings 29 and strikes one of the strips 32. The strips 32 hang free, i.e. are unattached at their bottom edges, so the moving ball raises the strip and passes through the meshwork. This may be enough to kill its momentum so that it drops to the ground but if its speed is sufficient it will strike the fence 17 and rebound. However it cannot pass back again through the meshwork since the strip, which extends below the horizontal strand at its bottom, is obstructed thereby and by the spaced vertical strands 27. The meshwork 26 extends close enough to ground 33 to confine balls that have been trapped between said meshwork and the fence 17. For the brackets 19 I prefer to use a structure where the meshwork strand is supported (FIG. 5) in a slot 41 of a retracting angle arm 42 that is rotatably pivoted by a pin 48 to a fixed vertical arm 44. The arm 44, which is stabilized by a cross member 46, is bolted by means of a bolt 47 to the wall 13 or a wire fence such as the fence 14. In the case of the latter, the bolt 47 extends through the fence and a plate or washer 48 to which it is secured by a nut 49. The distance from the wall or fence to the meshwork is determined by the length of a flexible cord 51 which is knotted through a hole 52 in the angle arm 42 and a cooperating hole 53 in the vertical arm 44.

Figure 3:
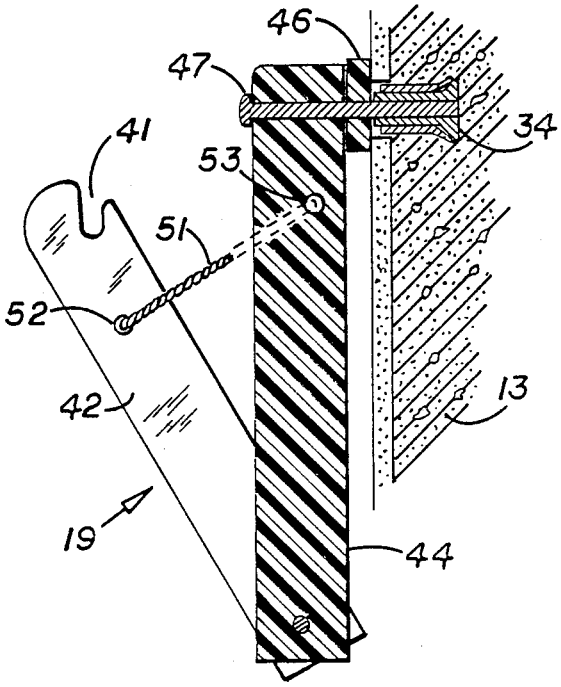
FIG. 3 is a sectional elevation of a portion of masonry wall with one of my supports attached.

In using my inveniion in the embodiment hereinabove described internally threaded plugs 34 (FIG. 3) are permanently, installed in the masonry wall 13 for attachment of the brackets 19 by means of the bolts 47, and the bolts 47 are also inserted into interstices of the chain link fences 14, 16, 17 to which they are locked by means of a large washer 48 and nut 49. Depending upon the security of the area from vandalism the brackets 19 can be left in place or removed when the courts are not in use. The running lengths 21–24 of meshwork to which the strips 32 have been attached are suspended from the brackets 19 so as to clear the ground, as described, a distance that will confine trapped balls.

The foregoing description has been exemplary rather than definitive of my invention for which I desire an award of Letters Patent as defined in the appended claims.

I claim:

1. An entrapment apparatus for regulation tennis balls comprising:

(A) a vertical ball confining structure bordering a playing field, said structure comprising a ball-repulsing surface facing said field, (B) a longitudinal meshwork spaced from said surface and suspended on the side thereof of said field, (1) said meshwork comprising a plurality of interconnected horizontal and vertical strands, (2) said strands defining openings large enough to permit passage of one of said balls, and (3) said meshworks comprising upper and lower horizontal edges thereof, (C) a plurality of flexible barrier strips comprising upper and lower horizontal edges thereof, (1) said strips being positioned between said meshwork and said wall, (2) said strips being impervious to the passage therethrough of a tennis ball, and (3) the upper edge of each of said strips being fastened lengthwise to one of said horizontal strands and the lower edges of said strips hanging free to a position blocking a horizontal plurality of said openings, (D) supporting means projecting from an elevated portion of said structure, and (E) means fastening said upper edge to said supporting means whereby balls will be allowed to pass through said meshwork and will rebound from said wall and will be deflected downwardly by said strips and come to rest on a surface between said meshwork and said wall.

2. The apparatus of claim 1 wherein said structures comprise fencing.

3. The apparatus of claim 2 comprising wires formed into chain link fencing.

4. The apparatus of claim 3 wherein said support means comprise brackets supported by said wires.

5. The apparatus of claim 4 wherein said brackets include pivotal arms yieldable upon human impact.

6. The apparatus of claim 1 wherein said strips comprise regulation tennis court netting.

7. The apparatus of claim 1 wherein said strips comprise closely spaced strands whereby said apparatus serves as a wind breaker.

8. The apparatus of claim 7 wherein said strands comprise polypropylene.

* * * * *